US006786439B2

(12) United States Patent
Zehr

(10) Patent No.: US 6,786,439 B2
(45) Date of Patent: Sep. 7, 2004

(54) RETRACTABLE ROD SCREENS

(75) Inventor: Melvin A. Zehr, Caldwell, ID (US)

(73) Assignee: Diamond Z Manufacturing, Caldwell, ID (US)

( * ) Notice: Subject to any disclaimer, the term of this patent is extended or adjusted under 35 U.S.C. 154(b) by 124 days.

(21) Appl. No.: 10/011,186

(22) Filed: Nov. 13, 2001

(65) Prior Publication Data

US 2002/0056773 A1 May 16, 2002

Related U.S. Application Data

(60) Provisional application No. 60/249,401, filed on Nov. 15, 2000.

(51) Int. Cl.[7] ..... B02C 13/286

(52) U.S. Cl. ..... 241/88.4; 241/89.2

(58) Field of Search ..... 241/88.4, 89.2, 241/189.1, 186.4, 101.761, 73, 285.1, 285.3, 89.1; 209/283

(56) References Cited

U.S. PATENT DOCUMENTS

| | | | | |
|---|---|---|---|---|
| 2,360,892 A | * | 10/1944 | Rench et al. | 241/89.2 |
| 2,422,399 A | | 6/1947 | Erickson | 146/76 |
| 2,450,492 A | | 10/1948 | Gruendler | 241/89 |
| 3,030,035 A | | 4/1962 | Stevenson | 241/89 |
| 3,891,152 A | * | 6/1975 | Guggenheimer | 241/73 |
| 3,929,647 A | | 12/1975 | Kempa | 209/395 |
| 4,253,574 A | | 3/1981 | Ross | 209/668 |
| 4,706,898 A | | 11/1987 | Schonfeld et al. | 241/73 |
| 4,997,135 A | | 3/1991 | Zehr | 241/101.7 |
| 5,018,674 A | | 5/1991 | Williams | 241/88.4 |
| 5,060,806 A | | 10/1991 | Savage | 209/668 |
| 5,397,002 A | | 3/1995 | Lambert | 209/347 |
| 5,562,257 A | | 10/1996 | Graveman et al. | 241/190 |
| 5,720,440 A | | 2/1998 | Bonner et al. | 241/101.761 |
| 5,740,922 A | | 4/1998 | Williams | 209/668 |
| 5,938,131 A | | 8/1999 | Thom, Jr. et al. | 241/73 |

FOREIGN PATENT DOCUMENTS

| | | |
|---|---|---|
| DE | 2923978 | 1/1981 |
| FR | 1523013 | 4/1968 |
| GB | 2144342 | 3/1985 |

* cited by examiner

*Primary Examiner*—Mark Rosenbaum
(74) *Attorney, Agent, or Firm*—Robert L. Shaver; Dykas, Shaver & Nipper

(57) ABSTRACT

An improved grinding apparatus or hammermill utilizing retractable bars as a hammermill screen, or as a support to a conventional hammermill screen. The ability to retract these bars which make up the screen of the hammermill assembly reduces the down time associated with inspecting, replacing, and repairing the bars, and clearing jammed material caught within the screen. When the retractable bars support a hammermill screen, retraction of the bars allows the screen to drop down from the hammermill for repair and cleaning.

23 Claims, 8 Drawing Sheets

RETRACTABLE ROD SCREENS

PRIORITY

This application incorporates by reference and claims priority from previously filed provisional application Ser. No. 60/249,401, filed on Nov. 15, 2000, entitled "Retractable Rod Screens."

BACKGROUND OF THE INVENTION

The present invention generally relates to grinders and hammermills, and, more particularly to grinders with a screen adjacent to a rotating hammermill.

Grinding machines, including those utilizing grinding means such as hammermills, grinders, drum chippers, and wheel chippers, are used for varying applications. These applications can include, amongst others: grinding tree stumps and slash from logging operations; grinding construction debris from buildings damaged by natural disasters, such as hurricanes or floods; shredding animal feeds, grinding used automobile tires, grinding wood, and grinding landfill material for compaction or disintegration purposes.

Many different kinds of grinders and hammermills are known in the prior art, including U.S. Pat. No. 4,997,135 to Zehr and U.S. Pat. No. 5,720,440 to Bonner et al. Generally, these grinders/hammermills utilize a hammermill assembly formed of a rotatable shaft to which radially extending hammers are affixed, interfitted within a semicircular hammer mill screen, such as is shown in FIG. 3 of Bonner (U.S. Pat. No. 5,720,440).

In use, the material to be ground is dropped into a hopper from which it passes into the screen chamber containing the rotating hammermill hammers, where it is broken apart and/or pulverized. Other configurations of grinders and shredders exist, each with a hammermill and a screen. The hammermill screen serves as a sieve, allowing ground material smaller than the sieve hole size of the hammermill screen to pass through, or literally to be thrown through the screen into a chute and onto some sort of discharge system, conveyor, auger, or other device by which it is carried away. Hammermill/grinder screens shown in the prior art include: screens having screen holes (Bonner), a "grate" (Zehr), a plate/grate system (Graveman), and curved ribs and spaced bars (Williams).

A typical problem with such grinding devices arises when a piece of material becomes lodged between the hammermill screen and the hammers, causing a jam. Material may also become wrapped around the hammermill, or clogged in the holes of the hammermill screen, and wrapped around the screen. The prior art method of relieving such a jam is, as described in Bonner, disassembling the grinding device in order to manually dislodge the material jammed therein. This step is time consuming and labor intensive. Some grinders are designed so that the screen of the grinder is in the shape of a section of a cylinder, which is removed by rotating it from adjacent the hammermill to a position in the feed intake of the hammermill. Even though the screen is typically made of thick metal, it may have been bent during operation, and rotating it and removing it is a demanding and time consuming job.

SUMMARY OF THE INVENTION

The present invention is an improved screen, particularly for hammermills, horizontal grinders, tub grinders, shredders, and other grinding apparatuses. The device of the invention can be utilized in any shredder or grinder which uses a rotating hammermill with an adjacent screen through which material is ejected.

The device is an improved grinding apparatus for use in grinding or commuting material. The improved grinding apparatus includes a frame for supporting the grinding apparatus, an inlet for receiving material to be ground, and a grinding means which is operatively connected to the inlet and typically mounted on a drive shaft. The grinding means is typically a hammermill and comminutes material to a smaller size. The device also includes a screen mounted around the hammermill or grinding means, and thus defining a screen chamber around the hammermill. Material enters the hammermill and is struck by hammers of the hammermill and driven through or into the screen. The screen of the improved grinding device is formed from a number of bars which extend parallel to and adjacent to the grinding means. The bars have a long axis, and the long axis of the bar is parallel with the long axis of the hammermill or grinding means. One or more of the bars may be extracted from the screen chamber, and inserted into the screen chamber by pulling or pushing on the bar, in a direction parallel with the long axis of the bar.

A bar extraction means is also utilized. Typically, the bar extraction means would be formed from a bar extraction tool of various designs. Bar extraction tools can be formed based on propulsion from hydraulic cylinders, mechanical pullers which use leverage or mechanical advantage, electrically driven screws, or pneumatically driven drives. The bar extraction tools of the invention attach to the bars which form the screen chamber and either push the bars into place around the hammermill, or pull them out of the hammermill region. The grinding device of the invention can be configured to include one extraction tool which is attachable sequentially to each of the bars around the hammermill, and is thus able to insert or remove any of the bars around the hammermill. The bar extraction tools can be configured so that there is one bar extraction tool for each of the bars around the screen chamber of the hammermill. The device of the invention may also include a first end wall and a second end wall which are attached to a right rail and a left rail of the frame. The first and second end walls further define the screen chamber. The first and second end wall contained openings, called bar passages, through which the bars pass in and out of the screen chamber, and on which the bars rest for support and positioning around the hammermill.

In one form, the present invention is utilized on a particular type of grinding apparatus known as a tub grinder. This tub grinder is utilized for comminuting a supply of material. Such a tub grinder will have a frame supporting the grinder's components, and may have the frame mounted on a locomotion means such as tires or treads. One type of tub grinder has a rotatable drum assembly which is mounted to the frame, with the drum assembly configured to rotate in relation to the frame. Although the device works equally well with stationary tubs, one configuration of the device operates with a rotating drum. The drum assembly has a rotatable sidewall adjacent to the frame, as well as a stationary tub bottom surface inside the side wall. The side wall is open at the top and able to receive the supply of material into a rotating drum space defined therein. The device of the invention also works with horizontal grinders, and other types of hammermills.

Although the operation of the device is described in use primarily with a tub grinder, it would work equally well with a variety of grinder configurations. The bottom surface of the tub grinder includes an opening in which the hammermill assembly is mounted. The hammers of the hammermill assembly typically extend into the rotating drum space, in the case of a drum grinder, and grind material which is brought into contact with the hammers of the hammermill. The rotatable drum assembly attaches to the frame and its rotation causes material to be pushed into the hammers in the hammermill opening, and by agitation prevents the bridging or arching of material over the hammermill. Such a tub grinder has a drive mechanism for rotating the rotatable sidewall, which causes material inside the sidewall to be pushed into contact with the hammermill assembly. Versions of hammermills with non-rotating drum assemblies are also possible, and may go by the name of shredders, horizontal grinders, chippers and mills. The retractable rod screen of the invention may also be utilized with these non-rotating drum assemblies.

The grinding mechanism of the invention comprises a hammermill assembly having a rotatable hammermill with attached hammers. Positioned below such a rotatable hammermill is a hammermill screen which is attached to the frame of the grinder, which may be a tub grinder. The hammermill screen comprises a plurality of bars mounted in the frame compartment adjacent to the hammermill. The bars act as any hammermill screen does, and are for impacting and breaking material thrown from the hammermill and hammermill hammers, and for rejecting material pieces which do not fit between the bars back to the hammermill for additional comminution. The hammermill screen and rotatable hammer define a hammermill chamber.

The frame further includes at least one bar extraction tool attachable to the frame and attachable to at least one of the bars. The bar extraction tool is for selectively removing the bars from the hammermill (or "working") chamber. In one embodiment, the bar extraction tool is one or more hydraulic cylinders which are attachable to the frame and to the bars for extraction and insertion of the bars into and out of the hammermill chamber from and to the side chamber. This allows the bars to be removed for installation, replacement, inspection, apparatus maintenance, and/or repair. It is preferred that the bars of the hammermill screen be positioned in the frame in an arc corresponding to an arc of rotation of the hammers of the hammermill, thereby defining a generally partially-cylindrical hammermill chamber.

Another version of the invention uses the retracting bars of the hammermill to support a conventional curved hammermill screen, which is suspended from two or more of the retractable bars. By this version of the device, the hammermill screen can be dropped out the bottom of a hammermill, instead of being rotated to the exposed upper portion of the hammermill for removal. The retractable rods are withdrawn, and the hammermill screen drops out for cleaning, repair, and replacement. The hammermill screen used in this way and supported by the retractable rods can be used with a rotating type grinder, or another configuration of grinders such as a horizontal grinder.

Accordingly, it is an object of the present invention to provide a hammermill screen with a reduced frequency of jamming, the option of changing the sizing of product, and a quicker removal of screens. It is another object of the present invention to provide a hammermill screen for quickly and easily clearing jams should they occur. It is another object of the present invention to simplify the installation, replacement, inspection, maintenance and/or repair of the hammermill screen.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive.

DESCRIPTION OF THE PREFERRED EMBODIMENTS

Figure 1:
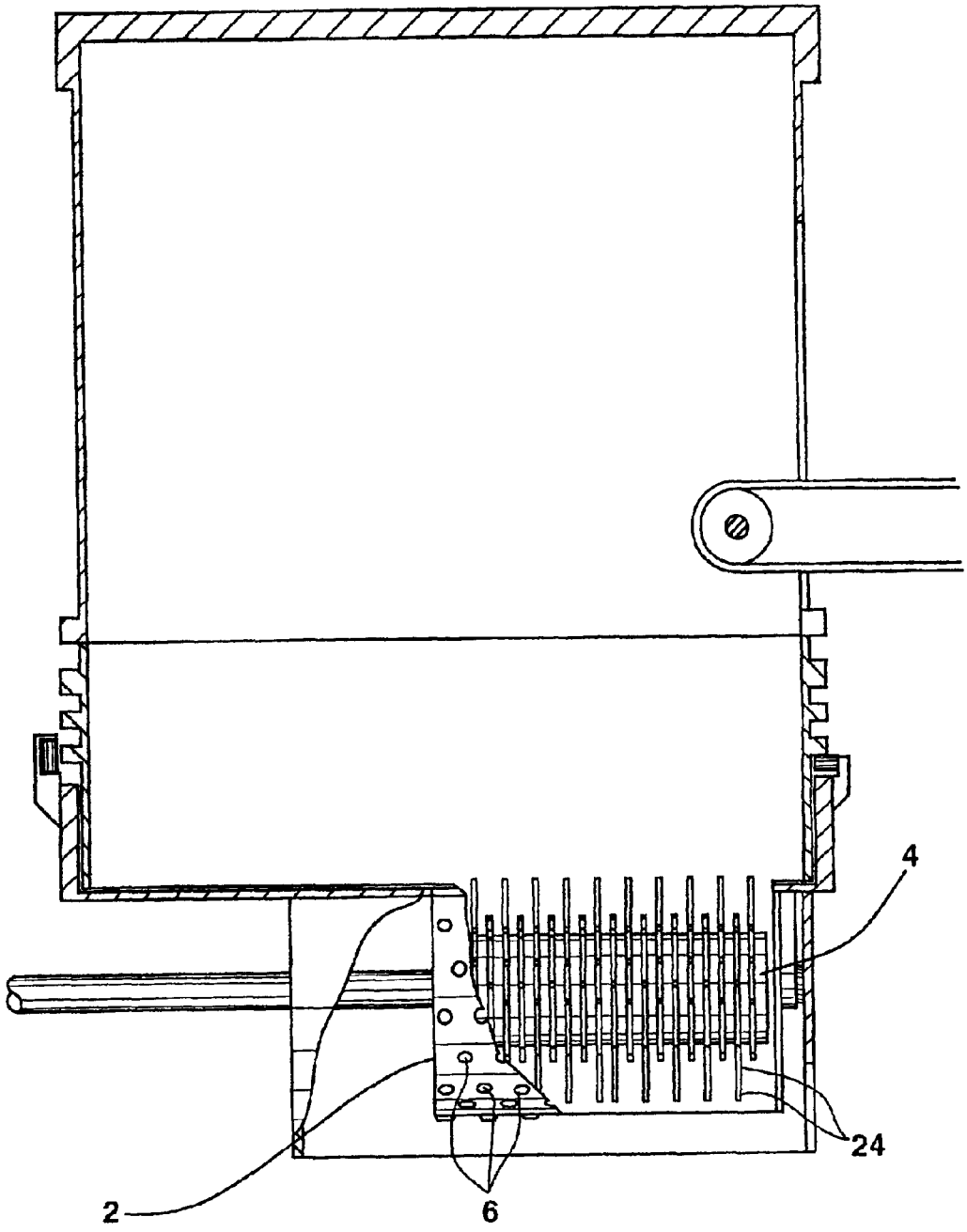
PRIOR ART FIG. 1
FIG. 1 is a partial, cross-sectional view of the hammermill assembly of a grinder type known in the prior art.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

Referring initially to FIG. 1, shown is a prior art type of grinding apparatus, namely a tub grinder. This tub grinder has a hammermill assembly 4 utilizing a driven, rotating hammermill having a plurality of hammers 24 which break apart refuse until it is small enough to fit through holes 6 within a hammermill screen 2. This arrangement is fine for certain applications, but other applications require much larger holes. In a screen such as this, which is formed into a semi-cylindrical shape which wraps around the hammers of the hammermill, removing the screen for repairs, replacement, or to remove jammed materials can become problematic. If it is jammed sufficiently tight, the hammermill itself may have to be removed so that the screen 2 can be accessed and freed. The normal procedure for replacing the hammermill screen 2 is to rotate the screen into the open region above the hammermill. This can be very difficult to do if the screen is warped or bent.

Figure 2:
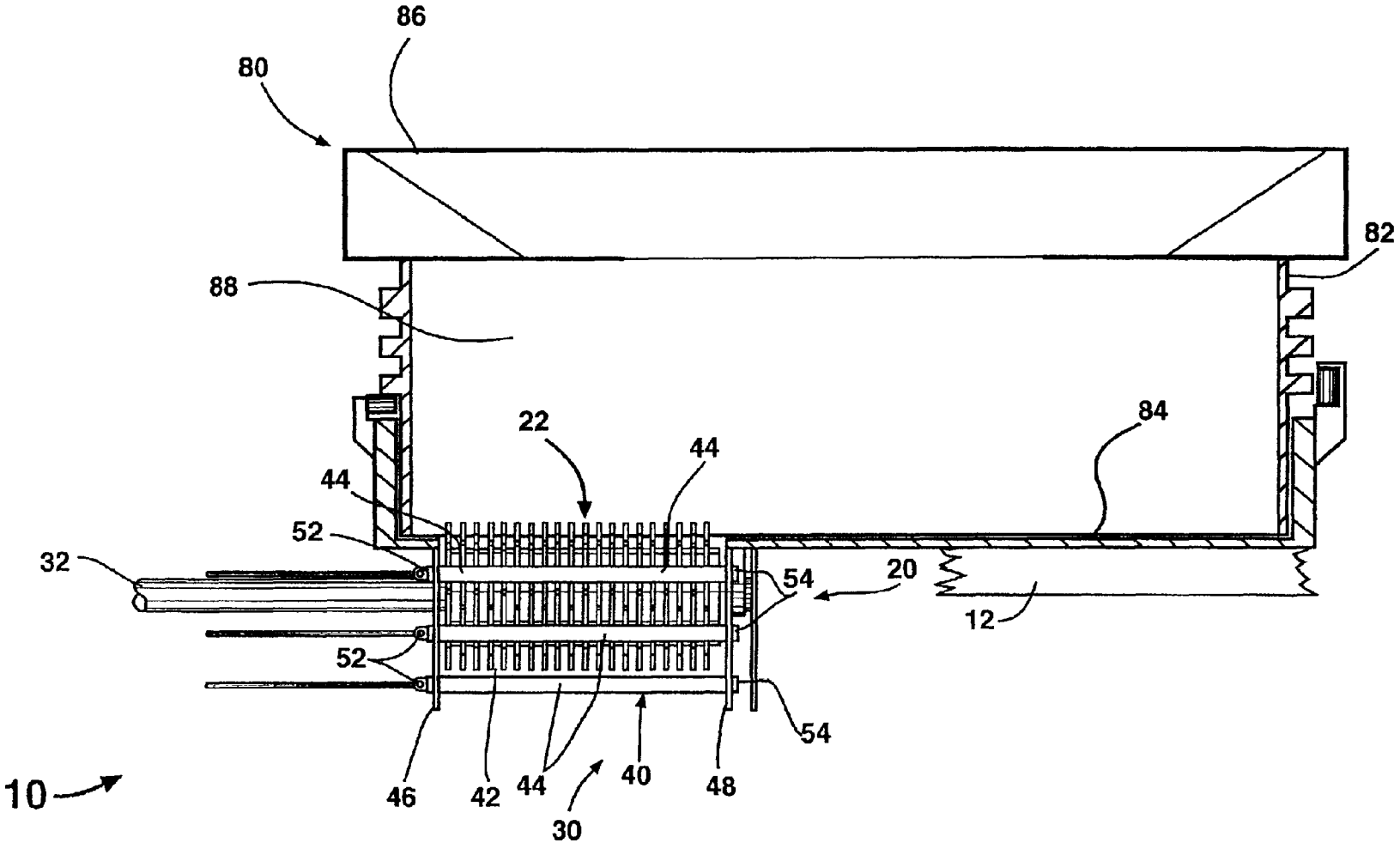
FIG. 2 is a partial, cross-sectional view of one embodiment of the present invention.

Referring now to FIG. 2, one embodiment of the present invention is shown. The improved grinding apparatus 10 has a frame 12 to which a housing 20 is attached. Located within the housing 20 is a grinding means, preferably a rotatable hammermill assembly 30. The rotatable hammermill assembly is formed of a driven, rotatable shaft 32 to which radially extending hammers are attached in the standard manner for either swinging or fixed hammers. Located within the housing 20 is a hammermill screen 40. This hammermill screen defines a screen chamber 42 which exists between the screen (a plurality of retractable bars 44) and the rotatable hammermill itself.

Figure 3:
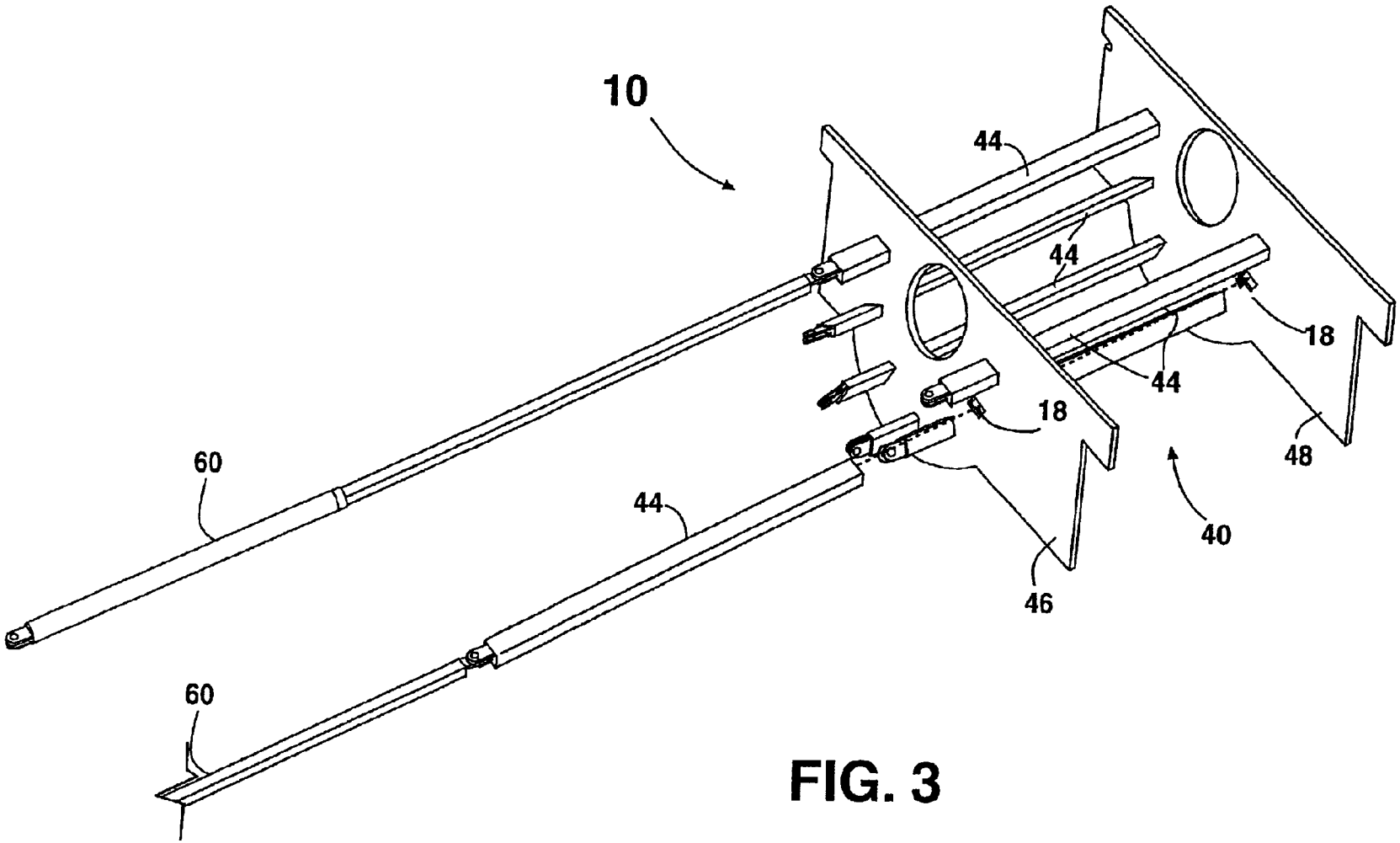
FIG. 3 is a perspective, partial view of one embodiment of the present invention.
Figure 4:
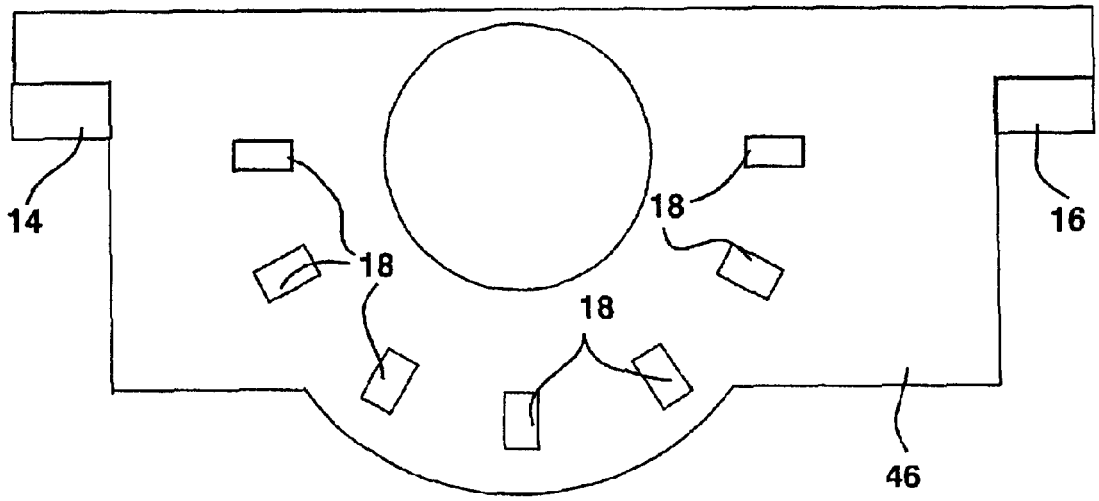
FIG. 4 is an end view of a screen chamber first end wall utilized with the present invention.

In one configuration of the invention, these retractable bars 44 are retractable from the screen chamber 42 and away from the hammermill to a region adjacent to the screen chamber. These bars have first and second ends, wherein the second end 54 of the bars are supported by the screen chamber second end wall 48, and the first ends 52 of the bars 44 are supported by the screen chamber first end wall 46. Being so supported, the bars 44 serve as a rigid screen means for use in comminuting material. The preferred bars are rectangular in cross-section, and are oriented with one of the narrower sides of the rectangle facing the hammermill, as shown in FIG. 3 and FIG. 4. Other cross-sectional shapes of bars are possible, such as round, square, triangular, oval, etc.

Referring back to FIG. 2, located above the hammermill assembly is a rotatable drum assembly 80. In other embodiments, the drum assembly itself may not rotate or other assemblies may be utilized instead of a rotating drum, such as horizontal oriented grinders. Other configurations might include feeding directly into the hammermill, or feeding horizontally into the hammermill. The rotatable drum assembly 80, shown in FIG. 2, has a rotatable sidewall 82 which is rotatably connected to a stationary bottom surface 84. The sidewall, the bottom surface and the open top 86 define a rotating drum space 88. In use, material to be ground is placed within the rotating drum space 88 for ultimate feeding through an inlet or opening 22 and into the screen chamber 44 for comminution. In this configuration of such a grinder, the hammers partially extend into the rotating drum space 88, and as the rotatable sidewall turns, material is brought into contact with the partially exposed hammers.

Referring now to FIG. 3, a portion of one preferred embodiment of the present invention 10 is shown in perspective view. This figure shows the improved hammermill screen 40 with other structures absent. In this view, the screen chamber first end wall 46 and screen chamber second end wall 48 are shown. These would be mounted on the grinder frame 12. These end walls 46 and 48 further define a plurality of bar passages 18 for receiving the retractable bars 44 utilized with the present invention. The retractable bars 44 furthermore are attachable to one or more bar extraction means, which is a bar extraction tool 60. One bar extraction tool 60 could be interconnected to one or to all of the of retractable bars 44. Individual bar extraction means, or bar extraction tools 60, could be connected to each individual bar 44, as shown in FIG. 3. The bar extraction tool(s) could comprise any number of devices, including but not limited to cables, electric or hydraulic motor driven screws, mechanical pullers, explosive pullers, pneumatic pullers, levers, hydraulic rams, etc. The embodiment shown in FIG. 3 shows one hydraulic cylinder bar extraction tool 60 attached to each retractable bar 44. As shown in FIG. 3, the retractable bars 44 can be pulled from the screen chamber towards the left of the drawing in FIG. 3 or FIG. 2. This would normally be the practice in order to clean or inspect a retractable bar 44. Another desirable alternative is to be able to push the retractable bars 44 to the right of the view shown in FIGS. 2 and 3, so that the bars may be replaced from that end, and the replacement bars pulled into place in the screen chamber 40. Pushing the bars to the right of the view shown in FIGS. 2 and 3 could also be utilized for repairs, cleaning, and inspection of the retractable bars 44.

FIG. 4 shows an end view of one embodiment of a screen chamber first end wall 46 utilized with one embodiment of the present invention. Such an end wall 46 would be attached to the grinding apparatus or tub grinder through attachment to the frame of the apparatus. A second end wall 48 would be likewise oriented and attached. In the embodiment shown, the frame further comprises subcomponents: a left rail 14 and right rail 16. Attachment could be through any of the standard manners including but not limited to welding, bolting, or other fastening means. The bar passages 18 located within the screen chamber first end wall 46 are shown in a position wherein they would be adjacent to the rotating hammermills of the rotatable hammermill assembly when installed, and in the preferred radial and partially cylindrical orientation. The bars 44 could be shaped to have a rectangular cross-section, as shown in the figures, or other cross-sectional shapes, such as square, triangular, round, etc. In one preferred embodiment, the bars 44 are four inches by six inches in cross-sections, of solid steel, and are ten feet in length. The bar extraction tools 60 are five inches by ninety-two inches in size. The end walls 46 and 48 are of two-inch thick steel.

Figure 5:
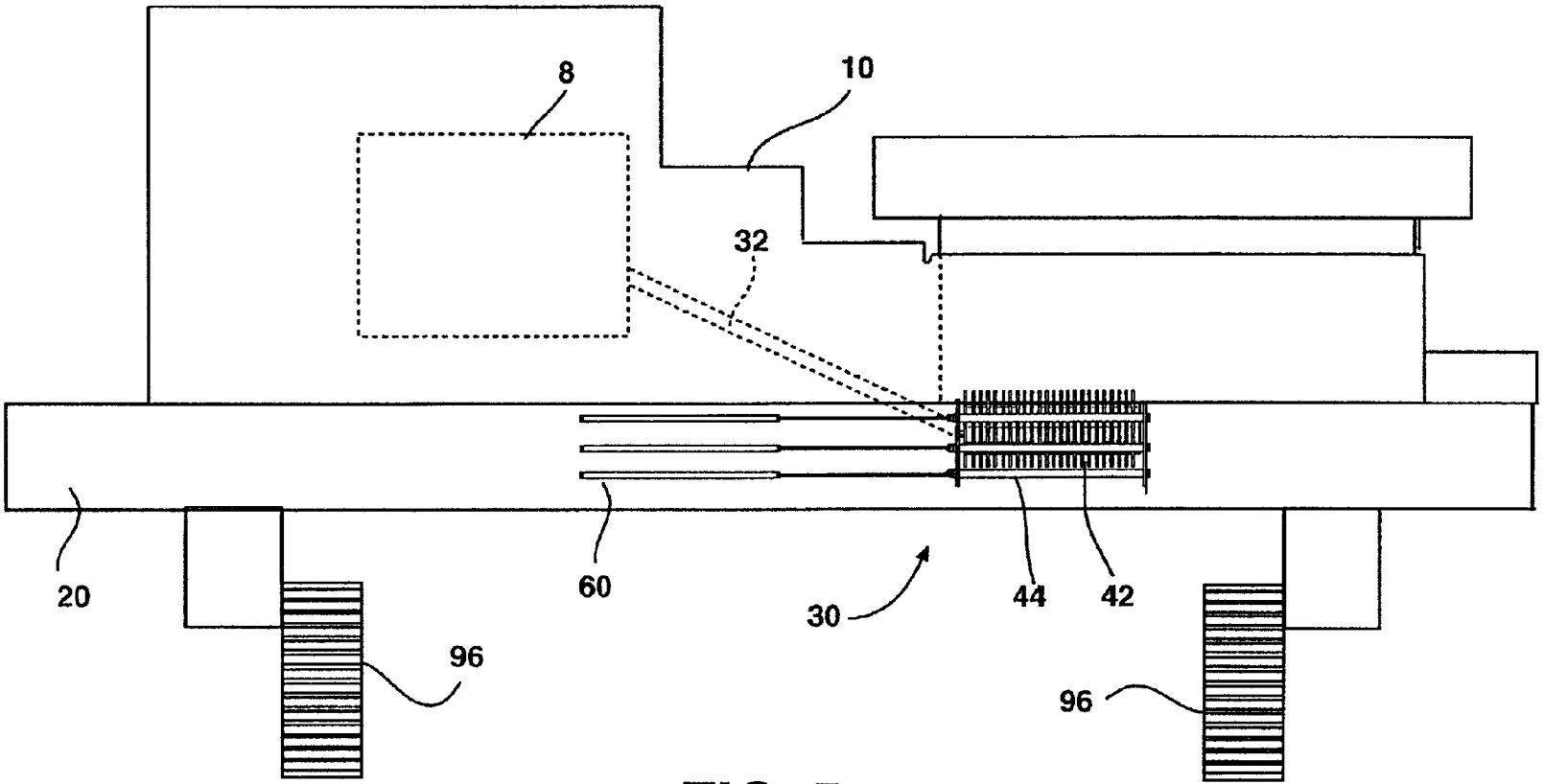
FIG. 5 is a side, environmental view of an embodiment of the present invention.

Referring now to FIG. 5, an environmental view of one embodiment of the present invention is shown. This embodiment shows the typical configuration of a portable grinding apparatus or tub grinder 10, being able to move to tracks 96 on wheels. Other configurations might include a stationary grinding apparatus or tub grinder 10. This figure shows that the driven shaft 32 attaches to a drive means or engine 8. Grinding apparatuses or tub grinders 10, such as shown here, are typically able to move on tracks 96 or wheels. Such a drive shaft 32 can be driven as shown in the prior art, including, but not limited to: electric motors, hydraulic drives, gas engines, and diesel engines. As shown in FIG. 5, when the bars 44 are in operation, they are pushed into the screen chamber 42. The bars 44 can be pulled from the screen chamber 42 to the region right or left of the screen chamber 42, for cleaning, repairing, replacing, etc. The bars 44 are connected to hydraulic cylinder bar extraction tools 60 which are connected to each individual bar 44. The hydraulic cylinder bar extraction tool 60 is attached to and mounted on the frame 20 of the grinding machine. When retracting the bars 44, material is removed by the sidewall 46 so that any material jammed or wrapped around the bars 44 falls down to the discharge system below the screen chamber 42.

Figure 6:
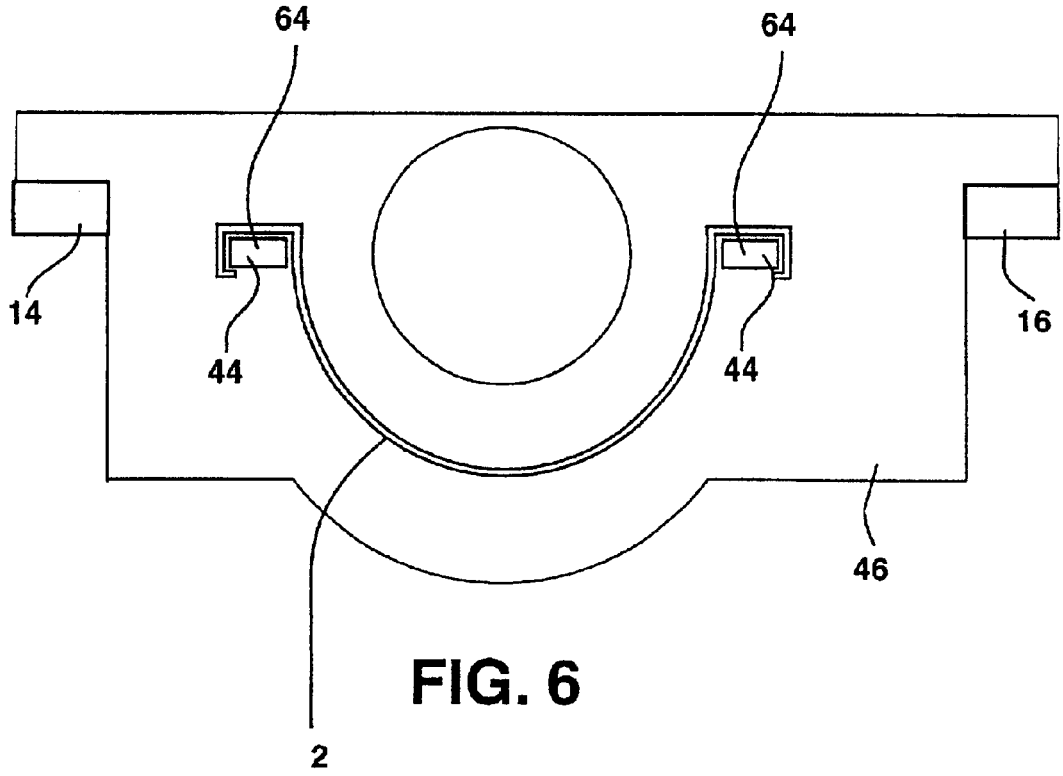
FIG. 6. is a side view of an embodiment of the invention.

FIG. 6 shows another preferred embodiment of the invention. In this embodiment, the retractable bars 44 support a conventional hammermill screen. The hammermill screen 2 is configured to rest on retractable rods 44 by rod brackets 64, which may encircle the retractable rods 44, or may partially encircle retractable rods 44. In this embodiment, when retractable rods 44 are withdrawn, the hammermill screen 2 drops down from the hammermill, and does not have to be rotated around it and lifted up for removal. The hammermill screen can be installed in the reverse manner, by raising the hammermill screen 2 into position adjacent the hammermill, and then extending the retractable rods 44 through rod brackets 64. Although FIG. 6 shows the hammermill screen 2 supported by 2 retractable rods 44, more or fewer retractable rods can be used to support and position the hammermill screen 2.

Figure 7:
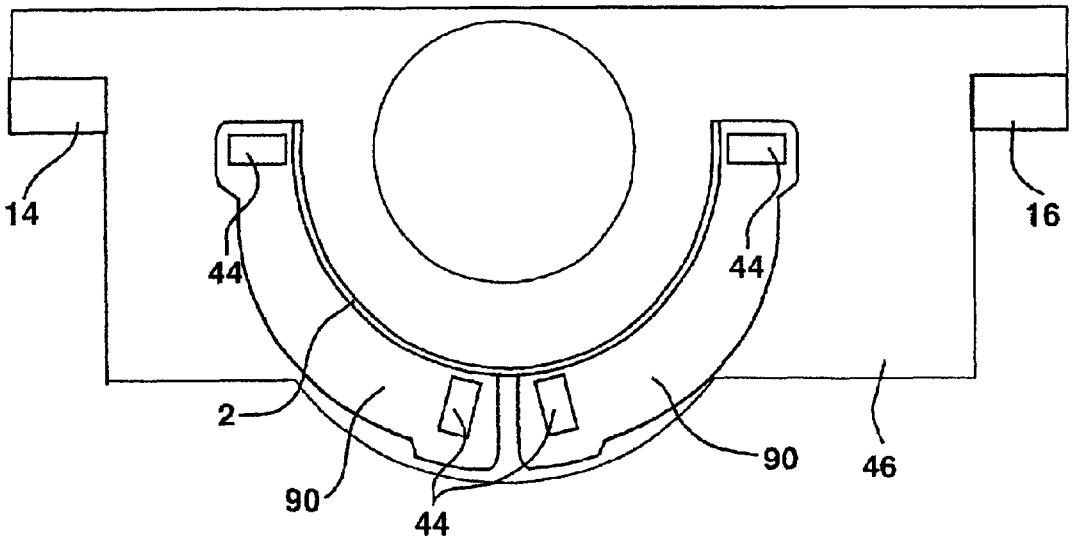
FIG. 7 is an end view of the invention in which retractable rods support a conventional hammermill screen.
Figure 8:
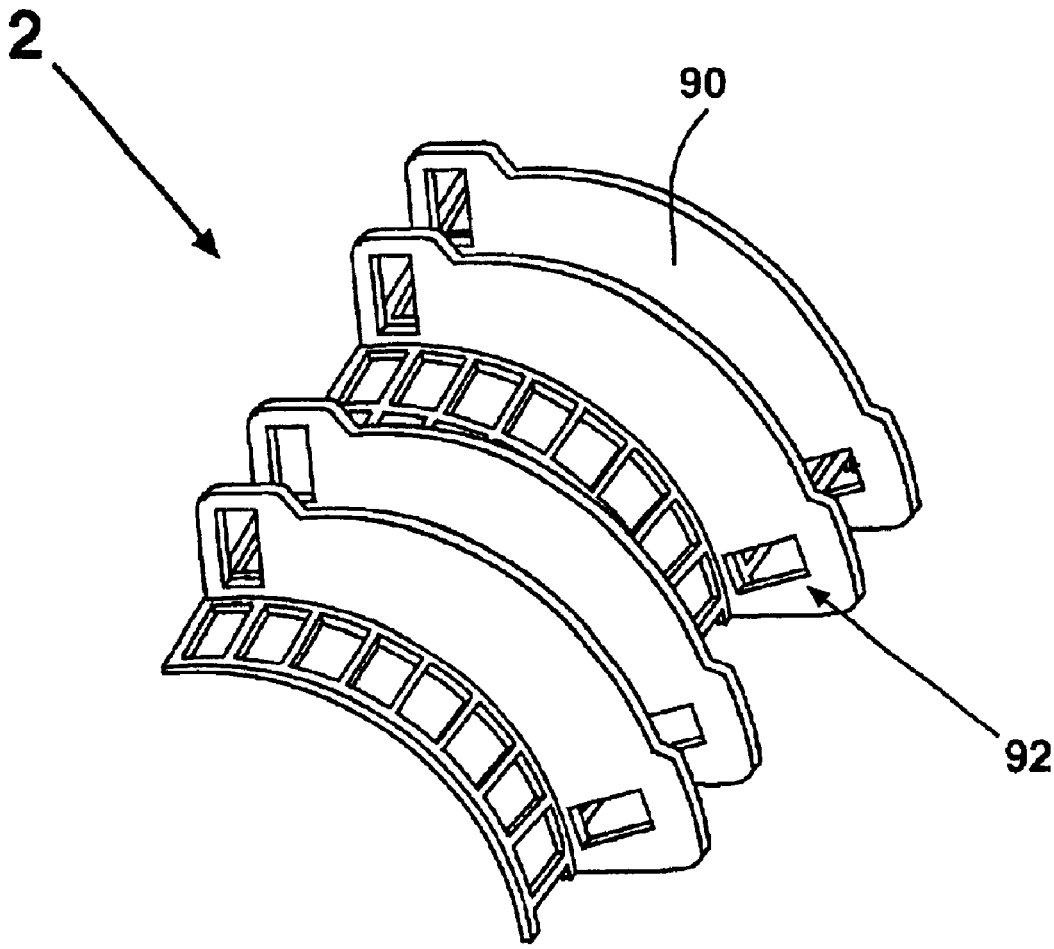
FIG. 8 is a perspective view of a hammermill screen which is supportable by retractable rods.

FIG. 7 shows another version of the device in which four of the retractable bars 44 are used to support a conventional hammermill screen 2, which further includes support brackets 90. FIG. 8 shows a perspective view of this conventional hammermill in a version which has fairly large sized holes. The support brackets 90 define bar passages 92 through which the retractable bars 44 extend in order to support and position the hammermill screen 2. A hammermill screen, as shown in FIG. 8, would be utilized to grind a number of materials, including wood, solid waste, building materials, and any other type of material for which hammermills are utilized.

While there is shown and described the present preferred embodiment of the invention, it is to be distinctly understood that this invention is not limited thereto but may be variously embodied to practice within the scope of the following claims.

I claim:

1. A grinding apparatus for comminuting material, said grinding apparatus comprising:

a frame for providing support for said grinding apparatus;

an inlet for receiving said material to be comminuted;

a grinding means operatively connected to said inlet and mounted on a driven shaft, for comminuting material;

a screen mounted about said grinding means and defining a screen chamber for receiving material to be comminuted from said inlet, said screen comprising a plurality of bars extending generally parallel and adjacent to said grinding means, said bars having a long axis; and wherein at least one of said bars may be extracted from said screen chamber, and inserted into the screen chamber, by pulling or pushing said bar parallel with said long axis.

2. The grinding apparatus of claim 1 in which said bar is removed from said screen chamber by use of a bar extraction means.

3. The grinding apparatus of claim 2 in which said bar extraction means is one or more bar extraction tools formed of one or more hydraulic cylinders, mechanical pullers, electric driven screws or pneumatic drives, which are attachable to said bars for extraction from said screen chamber, and for moving said bars into said screen chamber.

4. The grinding apparatus of claim 3 in which said bar extraction means is one said bar extraction tool which is attachable to each of said bars for extracting said bars from said screen chamber, and for moving said bars into said screen chamber.

5. The grinding apparatus of claim 3 in which said bar extraction means is a plurality of said bar extraction tools, one of which is attached to each of said bars for extraction from said screen chamber, and for moving said bars into said screen chamber.

6. The grinding apparatus of claim 1 in which said screen chamber has a first end wall and a second end wall attached to a right rail and a left rail of said frame, in which said first end wall and said second end wall define bar passages which provide support for said bars and through which said bars extend.

7. A grinding apparatus for comminuting material, said grinding apparatus comprising:

a frame for providing support for said grinding apparatus;

material grinding means mounted to said frame;

drive means operatively connected to said grinding means;

a rotatable drum assembly having a rotatable side wall, a stationary bottom surface and being open at the top, and defining therein a rotating drum space, said bottom surface having an opening therethrough for the passage of material to be ground, said rotatable drum attached to the frame in a position for alignment of the opening in said bottom surface with the grinding means for the passage of material to be ground into the grinding means;

means for rotating said rotatable side wall;

a screen positioned generally adjacent to said material grinding means, which defines a screen chamber, wherein said screen comprises a plurality of bars extending generally parallel and adjacent to said material grinding means, said bars having a long axis; and wherein at least one of said bars may be extracted from said screen chamber, and inserted into the screen chamber, by pulling or pushing said bar parallel with said long axis.

8. The grinding apparatus of claim 7 in which said bar is removed from said screen chamber by use of a bar extraction means.

9. The grinding apparatus of claim 8 in which said bar extraction means is one or more bar extraction tools comprising one or more hydraulic cylinder, mechanical puller, electric driven screw or pneumatic drive, which are attachable to said bars for extraction from said screen chamber, and for moving said bars into said screen chamber.

10. The grinding apparatus of claim 9 in which said bar extraction means is one said bar extraction tool which is attachable to each of said bars for extracting said bars from said screen chamber, and for moving said bars into said screen chamber.

11. The grinding apparatus of claims 9 in which said bar extraction means is a plurality of said bar extraction tools, one of which is attached to each of said bars for extraction from said screen chamber, and for moving said bars into said screen chamber.

12. A grinding apparatus for comminuting material, said grinding apparatus comprising:

a frame for supporting said grinding apparatus;

an inlet for receiving said material to be comminuted;

a grinding means adjacent to said inlet and mounted on a driven shaft;

one or more retractable bars which are extendable to a position adjacent to said grinding means, and retractable to a position away from said grinding means;

a screen configured for mounting on said one or more retractable bars, generally positioned adjacent to said grinding means and defining a screen chamber;

wherein said one or more retractable bars support and position said screen adjacent to said grinding means when extended to said screen chamber, and when retracted to a position away from said screen chamber, release said screen for removal from said grinding means.

13. The grinding apparatus of claim 12 in which said bar is removed from said screen chamber by use of a bar extraction means.

14. The grinding apparatus of claim 12 in which said bar extraction means is a bar extraction tool comprising one or more hydraulic cylinder, mechanical puller, electric driven screw or pneumatic drive, which are attachable to said bars for extraction from said screen chamber, and for moving said bars into said screen chamber.

15. The grinding apparatus of claims 14 in which said bar extraction means is one of said bar extraction tools which is attachable to each of said bars for extracting said bars from said screen chamber, and for moving said bars into said screen chamber.

16. The grinding apparatus of claims 14 in which said bar extraction means is a plurality of said bar extraction tools, one of which is attached to each of said bars for extraction from said screen chamber, and for moving said bars into said screen chamber.

17. The grinding apparatus of claim 12 in which said screen chamber has a first end wall and a second end wall attached to a right rail and a left rail of said frame, in which said first end wall and said second end wall each define a plurality of bar passages and provide support for said bars, and through which said bars extend.

18. A grinding apparatus for comminuting material, said grinding apparatus comprising:

a frame for supporting said grinding apparatus;

material grinding means mounted to said frame;

drive means operatively connected to said grinding means;

a rotatable drum assembly having a rotatable side wall, a stationary bottom surface and being open at the top, and defining therein a rotating drum space, said bottom surface having an opening therethrough for the passage of material to be ground, said rotatable drum attached to the frame in a position for alignment of the opening in said bottom surface with the grinding means for the passage of material to be ground into the grinding means;

means for rotating said rotatable side wall;

one or more retractable bars which are extendable to a position adjacent to said rotatable hammermill assembly, and retractable to a position away from said rotatable hammermill assembly;

a screen configured for mounting on said one or more retractable bars, generally positioned adjacent to said grinding means defining a screen chamber;

wherein said one or more retractable bars support and position said screen adjacent to said grinding means when extended to said screen chamber, and when retracted to a position away from said screen chamber, release said screen from said hammermill assembly.

19. The grinding apparatus of claim 18 in which said bar is removed from said screen chamber by use of a bar extraction means.

20. The grinding apparatus of claim 19 in which said bar extraction means is one or more bar extraction tools, which comprise a hydraulic cylinder, a mechanical puller, an electric driven screw or a pneumatic drive, which are attachable to said bars for extraction from said screen chamber, and for moving said bars into said screen chamber.

21. The grinding apparatus of claim 20 in which said bar extraction means is one bar extraction tool which is attachable to each of said bars for extracting said bars from said screen chamber, and for moving said bars into said screen chamber.

22. The grinding apparatus of claim 20 in which said bar extraction means is a plurality of said bar extraction tools, in which one bar extraction tool is attached to each of said bars for extraction from said screen chamber, and for moving said bars into said screen chamber.

23. The grinding apparatus of claim 18 in which said screen chamber has a first end wall and a second end wall attached to a right rail and a left rail of said frame, each of which define bar passages and provide support for said bars.

* * * * *